United States Patent [19]

Comberg et al.

[11] Patent Number: 4,651,047

[45] Date of Patent: Mar. 17, 1987

[54] PROJECTION TELEVISION DISPLAY TUBE

[75] Inventors: Albert A. Comberg, Aachen, Fed. Rep. of Germany; Alwin Knops, Hergenrath, Belgium; Heinrich A. Oepen, Stolberg; Dieter Wädow, Aachen-Hann, both of Fed. Rep. of Germany

[73] Assignee: U.S. Philips Corporation, New York, N.Y.

[21] Appl. No.: 738,107

[22] Filed: May 24, 1985

[30] Foreign Application Priority Data

Jun. 1, 1984 [EP] European Pat. Off. ..... 84200785.8

[51] Int. Cl.[4] ..... H01J 1/10; H01J 7/26

[52] U.S. Cl. ..... 313/22; 313/35

[58] Field of Search ..... 313/22, 32, 11, 35, 313/39, 12; 358/250

[56] References Cited

U.S. PATENT DOCUMENTS

| | | | |
|---|---|---|---|
| 3,531,674 | 9/1970 | Spencer | 313/44 |
| 3,914,010 | 10/1975 | Zeller | 313/12 |
| 4,529,905 | 7/1985 | Ohkoshi et al. | 313/35 |
| 4,543,510 | 9/1985 | Chiba et al. | 313/477 R |

FOREIGN PATENT DOCUMENTS

| | | | |
|---|---|---|---|
| 1194072 | 9/1985 | Canada | 313/22 |
| 111979 | 6/1984 | European Pat. Off. | 313/12 |
| 3400067 | 7/1984 | Fed. Rep. of Germany | 313/22 |
| 8403390 | 8/1984 | PCT Int'l Appl. | 313/477 R |
| 2124425 | 2/1984 | United Kingdom | 313/477 R |

*Primary Examiner*—Stewart J. Levy
*Assistant Examiner*—Hezron E. Williams
*Attorney, Agent, or Firm*—John C. Fox

[57] ABSTRACT

A projection television display tube having an evacuated envelope (1) with a display window (4) which has a display screen (5) on its inside and in front of which a light-permeable second window (6) is provided on the outside, a cooling liquid flowing through the space (7) between the display window (4) and the second window (6) from at least one inlet aperture to at least one outlet aperture. When in such a projection television display tube a cooling jacket(8) is provided at the area of the windows (4, 6) and around the said space (7) and is provided with at least one duct (9) and one pump (16) with connecting nipples (17,18) which transport the cooling liquid from the outlet aperture to the inlet aperture or apertures of the said space (7), an effective cooling is obtained with a power up to 40 W without outer pipes and without heat exchangers. By the forced circulation of the cooling liquid a good temperature compensation is obtained so that fewer stresses occur in the glass of the display window.

7 Claims, 3 Drawing Figures

PROJECTION TELEVISION DISPLAY TUBE

BACKGROUND OF THE INVENTION

The invention relates to a projection television display tube having an evacuated envelope with a display window which has a display screen on its inside and in front of which a light-permeable second window is provided on its outside, a cooling liquid flowing through the space between the display window and the second window from at least one inlet aperture to at least one outlet aperture.

Such a display tube is known from Netherlands Patent Application No. 80.03.360 laid open to public inspection. By means of an electron beam a frame is written on the display screen which comprises at least one phosphor layer or a pattern of different phosphors. As a result of the electron bombardment the temperature of the phosphor increases so that the luminous efficiency of the display screen decreases ("thermal quenching"). This phenomenon occurs in particular in display tubes for projection television in which for maintaining the required high luminous densities the display screen is scanned by electron beams of high beam currents. At the same time the temperature of the display window increases and a temperature gradient is formed at the display window. This gradient causes a mechanical stress in the display window which consists, for example, of glass. At high electron beam current and consequently high thermal load this may lead to fracture of the display window. In order to reduce said mechanical stresses in the display window by temperature differences ("thermal stress") and to avoid the reduction of the luminous efficiency, it is known from the already mentioned Netherlands Patent Application No. 80.03.360 to cool the display window and the display screen connected thereto. The space between the display window and the second window filled with cooling liquid in a first described embodiment is surrounded on the top, at the bottom and laterally by a metal cooling member which serves as a spacing member and as a heat radiator. As a result of the rise in temperature of the display window the cooling liquid heated by the display window moves along the display window upwards and past the second window downwards as a result of which the thermal energy from the centre of the display window is also dissipated via the cooling member. At low load, for example smaller than 5 W, the thermal energy is dissipated to the second window substantially by conduction. At higher load the above-described liquid flow occurs with an associated additional cooling by the cooling member which, however, is little effective. Moreover, an embodiment is described in which the cooling liquid is subjected to cooling outside the space. For that purpose the cooling liquid is applied to the space from the top side of the space through pipes or hoses and through a cooling chamber to the lower side, namely by flow caused by temperature differences in the cooling liquid. A disadvantage of such a tube is that when the tube in a projector has to be replaced the cooling liquid must be removed and the hoses and pipes, respectively, must be disconnected from the display tube.

It is the object of the invention, starting from the above-described prior art, to provide a display tube having a more active cooling system so that an effective cooling is obtained at a power up to 40 W.

Another object of the invention is to provide a display tube having a substantially homogeneous temperature distribution of the display screen.

Still a further object of the invention is to provide a display tube having a cooling without additional pipes and individual heat exchangers.

SUMMARY OF THE INVENTION

In order to achieve these objects, a display tube of the type mentioned in the opening paragraph is characterized according to the invention in that at the area of the windows and around the said space a cooling jacket is provided having at least one duct and one pump with connecting nipples which transport the cooling liquid from the outlet aperture(s) to the inlet aperture(s) of the said space.

In the display tube according to the invention the circulation of the cooling liquid and hence the greater part of the heat transport from the place of the production of the thermal energy, hence from the display screen, occurs by forced convection by means of the pump. The store of cooling liquid is to be proportioned so that its heat capacity is sufficient to attenuate short temperature fluctuations as a result of varying load of the display screen. In this cooling the cooling liquid generally flows laminarly past the warm display window and absorbs heat there. The cooling liquid is then guided by means of the pump from the outflow aperture or apertures through the duct in the cooling jacket where the cooling liquid delivers its thermal energy to the cooling jacket. As a result of the circulation of the liquid a better and more homogeneous temperature control is achieved than in the known cooling systems having a single cooling chamber. As a result of this the stress in the glass of the display tube is further reduced.

A further advantage of the display tube according to the invention is that no outer pipes or hoses are necessary for the connection to a heat exchanger and the pump as a result of which a much simpler assembly of the tube in a (projection) arrangement for displaying pictures is possible.

The cooling in a display tube according to the invention is essentially more effective than in the first embodiment of the cooling described in the already mentioned Netherlands Patent Application No. 80.03.360 because the cooling liquid between the display window and the second window is substantially pumped in only one direction and cooled in the cooling jacket. The pump may be accommodated anywhere in the duct between the outlet aperture and the inlet aperture. Preferably, one of the connection nipples is connected to (an) inlet or outlet aperture(s), the other connection nipple opening into the duct.

In order to avoid the occurrence of turbulences and associated fluctuations in the refractive index with greater certainty, it is ensured in a preferred embodiment, of the invention that the inlet or outlet aperture(s) change(s) smoothly into an initially widening chamber, the chamber being connected to one of the connecting nipples.

At least the outer wall of the cooling jacket preferably consists of metal and may comprise cooling fins. It is possible to cool the fins with air by forced cooling.

A preferred embodiment of a display tube according to the invention is characterized in that the said space through which the cooling liquid flows is bounded by two seals extending parallel to the direction of flow in the space, for example glass or metal strips, between the display window and the second window. When two strips are used on two sides of the display window, they may at the same time serve as spacer elements between the display window and the second window.

It is also possible for the second window to be the first element of the optical system of lenses of the picture display device.

When the display window is connected to the cone of the tube by means of a glass enamel it is advantageous to provide the adhering seam thus formed in the wall of the duct. As a result of this, the cooling liquid also flows around said heat-sensitive place so that the occurrence of thermal stresses is avoided.

BRIEF DESCRIPTION OF THE DRAWINGS

An embodiment of the invention is shown by way of example in the drawing and will be described in greater detail hereinafter. In the drawing.

DESCRIPTION OF THE PREFERRED EMBODIMENTS

Figure 1:
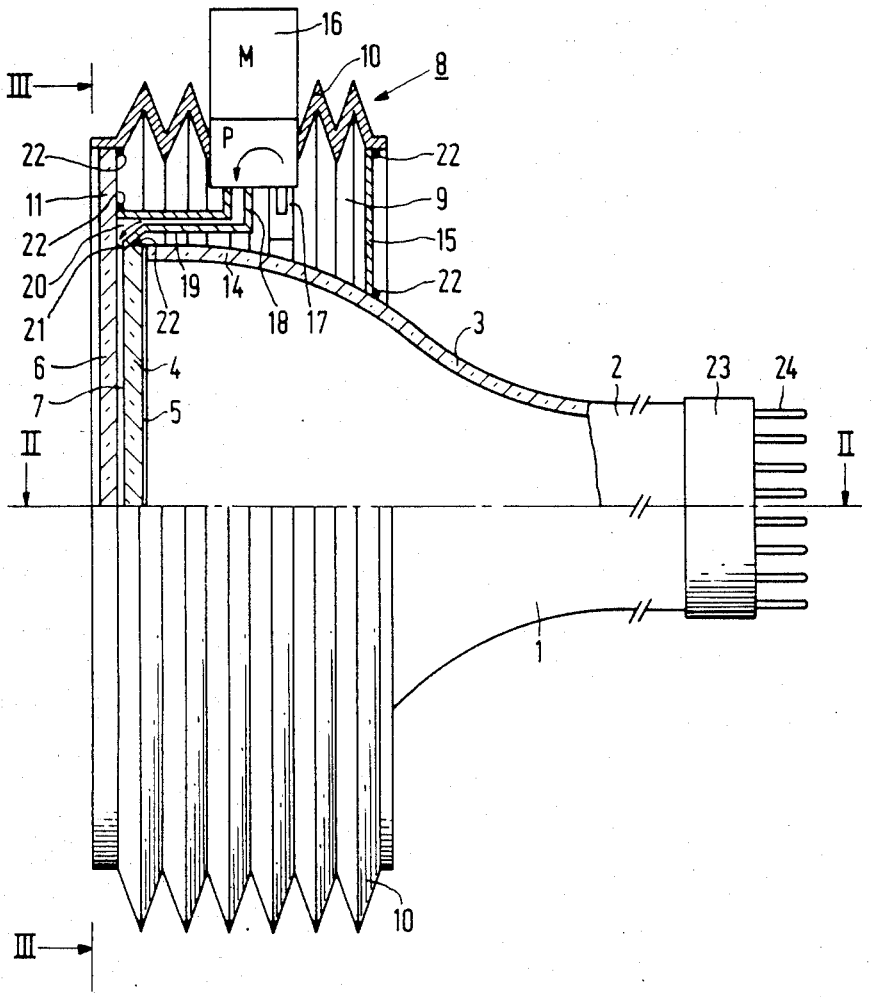
FIG. 1 is a side elevation, partly broken away, of a display tube according to the invention.

FIG. 1 is a side elevation, partly broken away, of a display tube according to the invention. This display tube comprises an envelope 1 consisting of a neck 2 and a cone 3 and sealed by means of a display window 4. On the inside of said display window a display screen 5 is provided. Substantially parallel to the outside of the display window 4 a light-permeable second window 6 is provided. Around the tube end at the area of the window 4 and 6 and of the space 7 present between them a cooling jacket 8 is provided. Said cooling jacket comprises a duct 9 which is bounded by an outer wall 10 of the cooling jacket, the side edge 11 of the second window 6, a glass strip 12 (see FIG. 2), the edge of the display window 4, the outer surface of the cone 14, and the rear wall 15 of the cooling jacket. Differences in expansion, if any, between the outer wall 10 and the end of the tube can be compensated for by the flexible rear wall 15 of the cooling jacket. A pump 16 having a motor M and a pump portion P with two nipples 17 and 18 is provided in the cooling jacket 18. The nipple 18 is connected via a pipe 19 to a widening chamber 20 which joins the inlet aperture 21 of the space 7. Said transition should be as smooth as possible to avoid turbulences and associated fluctuations in refractive index in the cooling liquid in the space 7. The outer wall 10 of the cooling jacket 8 is zig-zag-shaped so that cooling fins are formed. The outer wall 10 advantageously consists of aluminium and a material having an equally large thermal conductivity. Silicone rubber is preferably used as a sealing mass 22 since it has a great plasticity and a wide temperature range. The space 7, the duct 9 and the pump 16 are filled with cooling liquid (for example water or a mixture of ethylene glycol-water having a lower melting-point and a higher boiling point than water). The heat produced in the display screen is taken up by the cooling liquid via the display window. The warm cooling liquid is transported from the pump out of the space 7 into the duct 9. There the cooling liquid delivers the thermal energy absorbed therein partly to the wall 10 and the rear wall 15 of the cooling jacket and is then transported again into the space 7 by the pump. The direction of flow of the cooling liquid is indicated by arrows; of course, the direction of pumping may also be reversed. The tube furthermore comprises a tube base 23 having connection pins 24.

Figure 2:
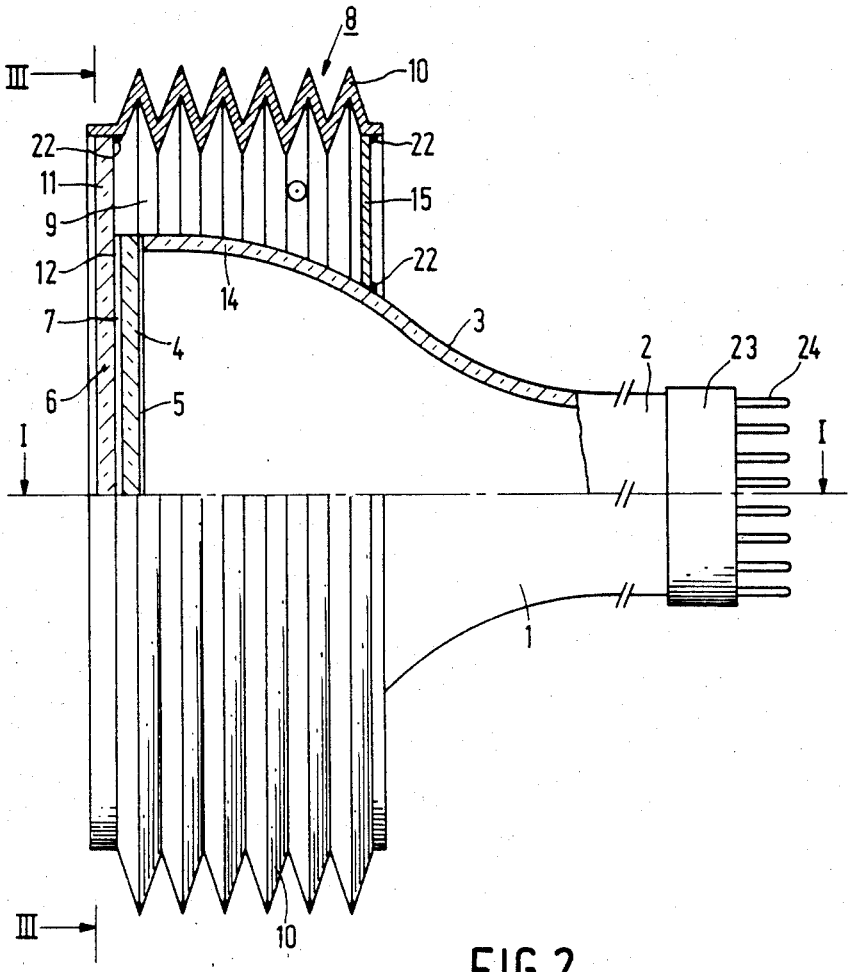
FIG. 2 is a side elevation, partly broken away, at right angles to the elevation of FIG. 1.

FIG. 2 is a side elevation, partly broken away, at right angles to the elevation of FIG. 1. The reference numerals correspond to those of FIG. 1.

Figure 3:
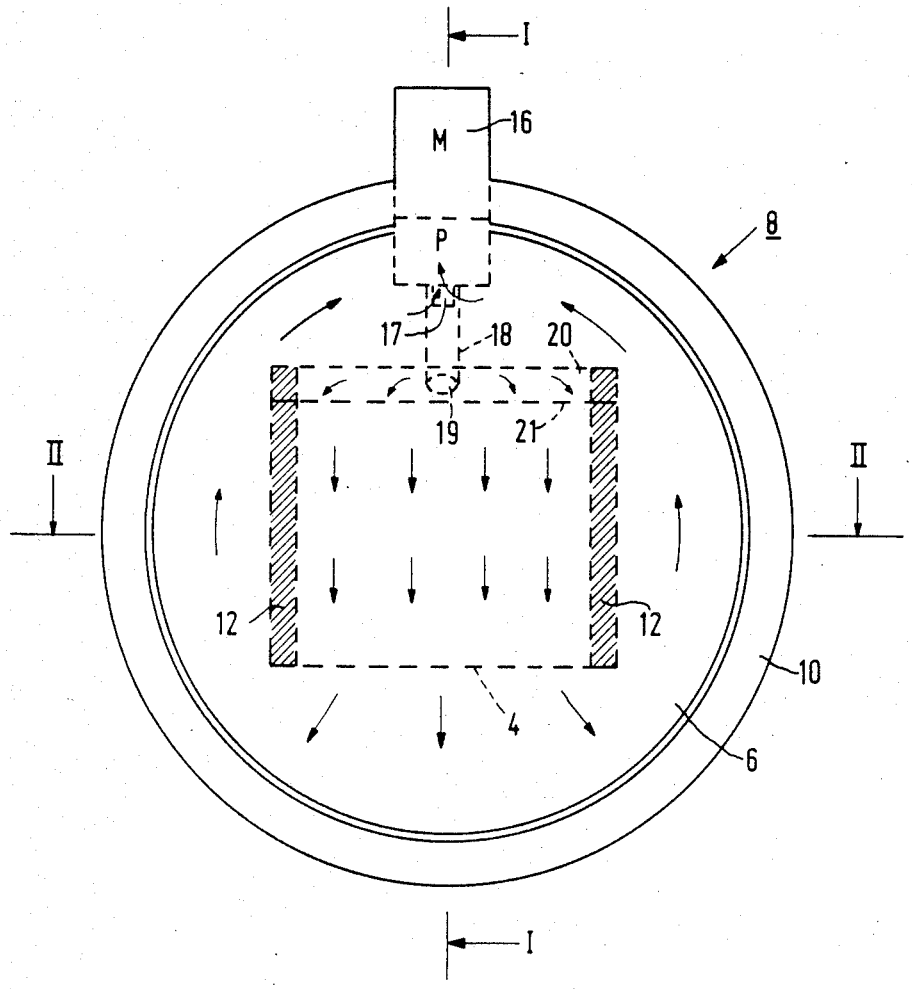
FIG. 3 is a front elevation of the tube shown in FIGS. 1 and 2.

FIG. 3 is a front elevation of the tube shown in FIGS. 1 and 2. The reference numerals again correspond to those of FIG. 1. In FIG. 3 the position of the seals and the directions of flow indicated by arrows are particularly clear. The cooling jacket 8 is shown to be circular but it may also be substantially rectangular just as the display window.

It is also possible to dye the cooling liquid to thus produce a filtering of the light originating from the display window 4.

The duct 9 may alternatively consist of two subducts.

Since the liquid flow is produced by a pump, the display tubes in a picture display device need not be arranged horizontally (display window vertically) but they may also be arranged and operated more or less vertically (Display window horizontally).

A cooling system for a projection television display tube is also described in European Patent Application No. (PHN 11 041) incorporated by reference here.

We claim:

1. A projection television display tube having: an evacuated envelope having inner and outer surfaces, the envelope consisting of a neck, a cone and a display window at one end, which window has a display screen on its inner surface; a light permeable second window outside the tube, spaced apart from the display window, the space between the display window and the second window adapted for transporting cooling liquid from at least one inlet aperture to at least one outlet aperture; and at least one seal between the display window and the second window; characterized in that a cooling jacket surrounds a portion of the outer surface of the envelope, the jacket comprised of an outer wall and a rear wall, and defining a duct bounded by: (1) the outer and rear walls of the jacket, (2) the edges of the display window, second window, and at least one seal between the display window and second window, and (3) the outer surface of the cone; and further characterized in that one pump is provided in the jacket, the pump having connecting nipples for transporting the cooling liquid from the outlet aperture to the inlet aperture of the space.

2. A display tube as claimed in claim 1 characterized in that one of the connecting nipples is connected to the inlet aperture and the other connecting nipple opens into the duct.

3. A display tube as claimed in claims 2 or 1, characterized in that the aperture(s) are connected to the nipple via a widening chamber.

4. A display tube as claimed in claim 1, characterized in that the cooling jacket consists substantially of metal and includes cooling fins.

5. A display tube as claimed in claim 1, characterized in that the said space is bounded on two sides by two seals provided parallel to the direction of flow in the space and between the two windows.

6. A display tube as claimed in claim 1, characterized in that the display window is connected to the cone of the tube by means of a glass enamel.

7. A display tube as claimed in claim 1, characterized in that one of the connecting nipples is connected to the outlet aperture(s) and the other connecting nipple opens into the duct.

* * * * *